US007301266B2

(12) United States Patent
Chen

(10) Patent No.: US 7,301,266 B2
(45) Date of Patent: Nov. 27, 2007

(54) FIELD EMISSION LIGHTING DEVICE

(75) Inventor: Ga-Lane Chen, Fullerton, CA (US)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 215 days.

(21) Appl. No.: 11/193,905

(22) Filed: Jul. 29, 2005

(65) Prior Publication Data

US 2006/0055302 A1 Mar. 16, 2006

(30) Foreign Application Priority Data

Sep. 10, 2004 (CN) ..... 2004 1 0051486

(51) Int. Cl.
*H01J 1/02* (2006.01)

(52) U.S. Cl. ..... 313/309; 313/495; 313/336; 313/351

(58) Field of Classification Search ..... 313/495, 313/309, 336, 351
See application file for complete search history.

(56) References Cited

U.S. PATENT DOCUMENTS 5,447,763 A * 9/1995 Gehlke ..... 428/34.1
5,565,754 A * 10/1996 Pietrzak ..... 313/496
5,825,122 A * 10/1998 Givargizov et al. ..... 313/336
6,781,327 B2 8/2004 Ohsawa

* cited by examiner

*Primary Examiner*—Vip Patel
(74) *Attorney, Agent, or Firm*—Morris Manning Martin LLP; Tim Tingkang Xia, Esq.

(57) ABSTRACT

A lighting device includes a cathode (11), a cover (12), an insulation layer (13), an emitter base (18), a molybdenum tip (19), a phosphor layer (15), an anode (16), and a silicon oxide layer (17). The cover is formed on the cathode. The insulation layer is formed on the cover. The base is formed on the insulation layer. The molybdenum tip is formed on the base. The phosphor layer is spaced apart from the molybdenum tip. The anode is formed on the phosphor layer. The silicon oxide layer is formed on the anode.

20 Claims, 3 Drawing Sheets

FIELD EMISSION LIGHTING DEVICE

FIELD OF THE INVENTION

The present invention relates to electronic lighting technology, and particularly to a lighting device employing electron emission.

BACKGROUND OF THE INVENTION

Various lighting technologies provide substitutes for sunlight in the 425-675 nm spectral region. In this spectral region, sunlight is most concentrated, and human eyes have evolved to be most sensitive. Technologies for efficiently creating visible light are continuously being developed. Such development may be viewed as the history of lighting.

A graph quantifying an aspect of the recent history of lighting is shown in FIG. 5. The vertical axis indicates luminous efficiency, in units of lumens per watt ("lumen" being a measure of light which factors in the human visual response to various wavelengths). The horizontal axis indicates time, in units of years A.D.

Three traditional lighting technologies are combustion, incandescence and high intensity discharges (HID). The progress of luminous efficiency of combustion, incandescence and HID technology are respectively represented by lines 30, 32, 34 in FIG. 5. The luminous efficacies of these technologies have made significant gains over the past 150 years. However, the progress appears to have virtually stalled in recent years. What is needed, therefore, is a lighting device with high luminous efficiency.

SUMMARY

A first preferred embodiment provides a lighting device including a cathode, a cover, an insulation layer, a emitter base, a molybdenum tip, a phosphor layer, an anode and a silicon oxide layer. The cover is formed on the cathode. The insulation layer is formed on the cover. The emitter base is formed on the insulation layer. The molybdenum tip is adjoining the emitter base. The phosphor layer is spaced apart from the molybdenum tip. The anode is on the phosphor layer. The silicon oxide layer is on the anode.

A second preferred embodiment provides a lighting device including a non-conductive substrate, a cover, a cathode, an insulation layer, a emitter base, a molybdenum tip, a phosphor layer, an anode on the phosphor layer and a silicon oxide layer. The cover is on the non-conductive substrate. The cathode is on the cover. The insulation layer is on the cathode. The emitter base is on the insulation layer. The molybdenum tip is adjoining the emitter base. The phosphor layer is spaced apart from the molybdenum tip. The anode is on the phosphor layer. The silicon oxide layer is on the anode.

Preferably, the emitter base defines a diameter in the range of about 10 nanometers to about 100 nanometers. The molybdenum tip defines a bottom diameter essentially equal to the diameter of the emitter base. The molybdenum tip defines an upper diameter in the range of about 0.5 nanometers to about 10 nanometers. The emitter base and the molybdenum tip together define a height in the range of about 100 nanometers to about 2000 nanometers.

Each of the molybdenum tips may be closely combined with the emitter base. Because the combined molybdenum tips and the emitter base have good mechanical strength, excellent field-emission capability and good Young's modulus, the combined molybdenum tips and the emitter base can be subjected to relatively high voltage electrical fields without being damaged.

A high voltage electrical field may ensure a high current of field emission. The high current of field emission gives the lighting device a high luminosity, with visible light having satisfactory brightness being obtained. Therefore the lighting device and the lighting device with the molybdenum tips and the emitter base may emit light having relatively high brightness. The brightness is about 10 to about 1000 times that of a comparable light emitting diode (LED) or high intensity discharge (HID) lamp.

Other advantages and novel features of the embodiments will become more apparent from the following detailed description when taken in conjunction with the accompanying drawings, in which:

DETAILED DESCRIPTION OF PREFERRED EMBODIMENTS

Figure 1:
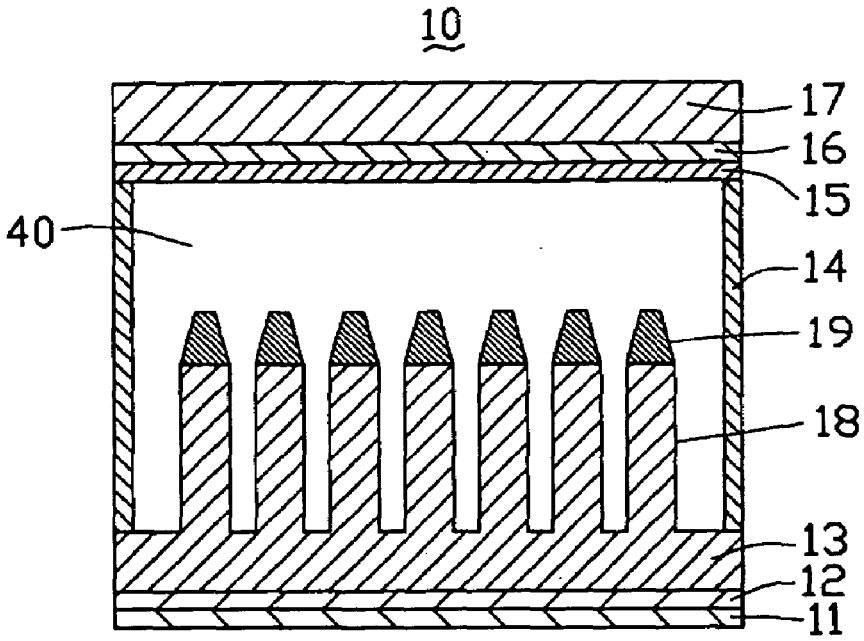
FIG. 1 is a schematic, cross-sectional view of a lighting device in accordance with a first preferred embodiment of the present invention.

Referring to FIG. 1, a first preferred embodiment provides a lighting device 10 including a substrate (not shown), a cathode 11, a cover 12, an insulation layer 13, at least one silicon nitride base 18, one or more molybdenum tips 19, a phosphor layer 15, an anode 16, a sidewall 14, and a silicon oxide ($SiO_2$ or $SiO_x$) layer 17.

The substrate may be made of a metal or metal alloy. The metal may be silver (Ag) or copper (Cu). Such metal or metal alloy substrate may be smooth, to facilitate formation of the cathode 11.

The cathode 11 formed on the substrate may be an electrically conductive material selected from the group consisting of copper (Cu), silver (Ag), and gold (Au). The cathode 11 is preferably formed to have a thickness of less than 1 micrometer.

The cover 12 may be a silicon layer formed by a depositing process. The formed cover 12 may serve as a nucleation layer on the cathode 11. The nucleation layer may have a relatively small thickness, preferably less than 1 micrometer. Such nucleation layer provides an environment for nucleation of the insulation layer 13. Such nucleation facilitates deposition of the insulation layer 13 on the cover 12.

The insulation layer 13 is preferably deposited with silicon nitride (i.e., SiNx), and is deposited on the cover 12. The insulation layer 13 is deposited with, for example, the same material as the silicon nitride base 18. Preferably, the insulation layer 13 and the silicon nitride base 18 are simultaneously formed as a whole. Two process steps may achieve this formation. In the first process step, a relatively thick silicon nitride layer is deposited by a chemical vapor deposition method, a plasma enhanced chemical vapor deposition method, or an ion beam sputtering method. In the second process step, the deposited silicon nitride layer is partially etched. After the etching step, the remaining silicon nitride layer includes the insulation layer 13 and the silicon nitride base 18 on the insulation layer 13.

The silicon nitride base 18 may be a silicon nitride cylinder on the insulation layer 13. Each of the molybdenum tips 19 may have a cone shape, and may be deposited on the silicon nitride base 18. The molybdenum tips 19 may be deposited by a sputtering method, a magnetron sputtering method, an ion beam sputtering method, a dual ion beam sputtering method, and another kind of glow discharge deposition method. Additionally, the molybdenum tips 19 may be arrayed on and adjoin the silicon nitride base 18.

A bias voltage may be applied to the cathode 11, so that an electrical field is established. The electrical field drives electrons out of each of the molybdenum tips 19 to the phosphor layer 15. The phosphor layer 15 includes a phosphor material. The phosphor material generates visible light after being bombarded with the electrons.

The electrons are emitted to the phosphor layer 15 through, for example, a vacuum. The vacuum may be located in a space 40 generally between the anode 16 and the cathode 11. In particular, the space 40 may be cooperatively defined by the molybdenum tips 19, the sidewall 14, the insulation layer 13 and the phosphor layer 15. The phosphor layer 15 is spaced apart from the molybdenum tips 19, so that a completely uninterrupted portion of the space 40 exists left between the anode 16 and the cathode 11.

The anode 16 may be deposited by using a mixture of argon and oxygen gases in a DC reactive sputtering technique or an RF reactive sputtering technique. The deposited anode 16 may be an indium tin oxide (ITO) layer.

The silicon oxide layer 17 may be a transparent layer on the anode 16. The transparent layer may be a transparent glass plate. The silicon oxide layer 17 is deposited by a DC reactive sputtering technique or an RF reactive sputtering technique. In such deposition, a mixture of argon and oxygen gases is used.

Figure 2:
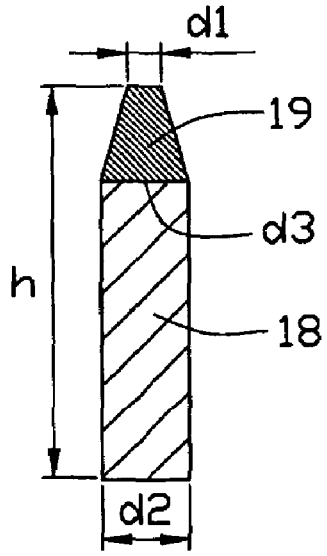
FIG. 2. is an enlarged view of an emitter sub-assembly of the lighting device of FIG. 1.

Referring to FIG. 2, the silicon nitride base 18 may define a diameter d2 in the range of about 10 nanometers to about 100 nanometers. Preferably, each of the molybdenum tips 19 defines a bottom diameter d3 essentially equal to the diameter d2 of the silicon nitride base 18. Each of the molybdenum tips 19 defines an upper diameter d1 in the range of about 0.5 nanometers to about 10 nanometers, and defines an aspect ratio in the range from about 10 to about 4000, and preferably from about 20 to about 400. The silicon nitride base 18 and a corresponding single molybdenum tip 19 together define a height h in the range of about 100 nanometers to about 2000 nanometers.

Figure 3:
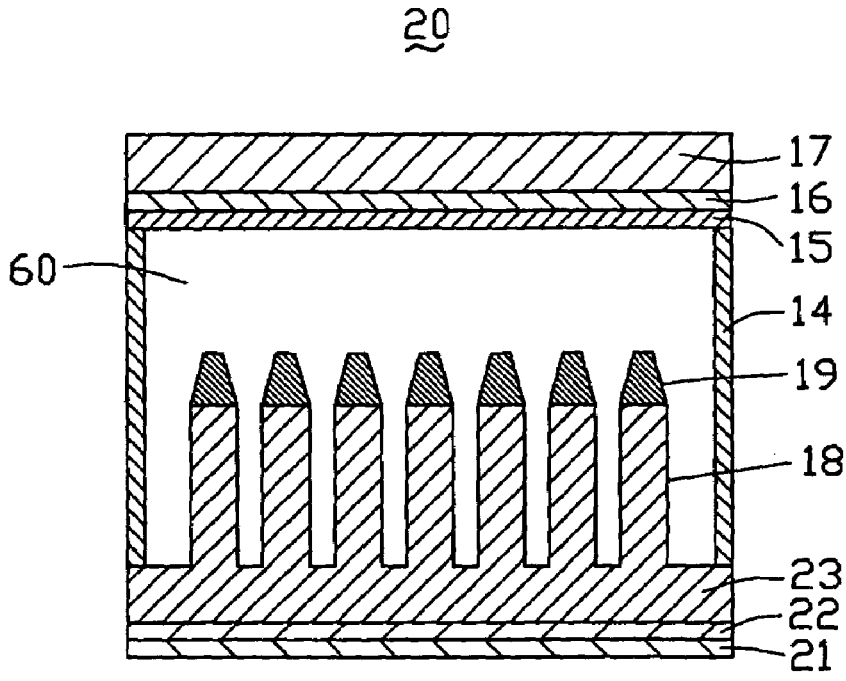
FIG. 3 is a schematic, cross-sectional view of a lighting device in accordance with a second preferred embodiment of the present invention.

Referring to FIG. 3, a second preferred embodiment provides a lighting device 20 including a non-conductive substrate (not shown), a cover 21, a cathode 22, an insulation layer 23, at least one silicon nitride base 18, one or more molybdenum tips 19, a phosphor layer 15, an anode 16, a sidewall 14, and a silicon oxide ($SiO_2$ or $SiO_x$) layer 17.

The non-conductive substrate may be made of a material selected from the group consisting of silicon and glass. The cover 21 may serve as a nucleation layer formed on the non-conductive substrate. The nucleation layer may be a silicon layer.

The cathode 22 may be formed on the cover 21, and may be formed of an electrically conductive material selected from the group consisting of copper (Cu), silver (Ag) and gold (Au). The cathode 11 is preferably formed to have a thickness of less than 1 micrometer.

The insulation layer 23 is preferably deposited with silicon nitride (i.e., SiNx), and is deposited on the cathode 22. The insulation layer 23 is deposited with, for example, the same material as the silicon nitride base 18. Preferably, the insulation layer 23 and the silicon nitride base 18 are simultaneously formed as a whole. Two process steps may achieve this formation. In the first process step, a relatively thick silicon nitride layer is deposited by a chemical vapor deposition method, a plasma enhanced chemical vapor deposition method, or an ion beam sputtering method. In the second process step, the deposited silicon nitride layer is partially etched. After the etching step, the remaining silicon nitride layer includes the insulation layer 23 and the silicon nitride base 18 on the insulation layer 23.

The silicon nitride base 18 may be a silicon nitride cylinder on the insulation layer 23. Each of the molybdenum tips 19 may have a cone shape, and may be deposit on the silicon nitride base 18. The molybdenum tips 19 may be deposited by a sputtering method, a magnetron sputtering method, an iron beam sputtering method, a duel ion beam sputtering method, or another kind of glow discharge deposition method. Additionally, the molybdenum tips 19 may be arrayed on and adjoin the silicon nitride base 18.

A bias voltage may be applied to the cathode 22, so that an electrical field is established. The electrical field drives electrons out of each of the molybdenum tips 19 and to the phosphor layer 15. The phosphor layer 15 includes a phosphor material. The phosphor material generates visible light after being bombarded with the electrons.

The electrons are emitted to the phosphor layer 15 through, for example, a vacuum. The vacuum may be located in a space 60 generally between the anode 16 and the cathode 22. In particular, the space 60 may be cooperatively defined by the molybdenum tips 19, the sidewall 14, the insulation layer 23 and the phosphor layer 15. The phosphor layer is spaced apart from the molybdenum tips 19, so that a completely uninterrupted portion of the space 60 exists between the anode 16 and the cathode 22.

The anode 16 may be deposited by using a mixture of argon and oxygen gases in a DC reactive sputtering technique or an RF reactive sputtering technique. The deposited anode 16 may be an indium tin oxide (ITO) layer.

The silicon oxide layer 17 may be a transparent layer on the anode 16. The transparent layer may be a transparent glass plate. The silicon oxide layer 17 is deposited by a DC reactive sputtering technique or an RF reactive sputtering technique. In such deposition, a mixture of argon and oxygen gas is used.

Figure 4:
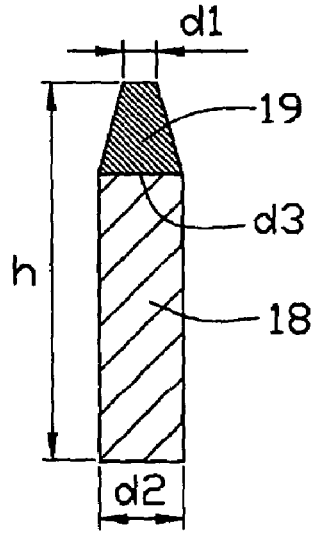
FIG. 4 is an enlarged view of an emitter sub-assembly of the lighting device of FIG. 3.
Figure 5:
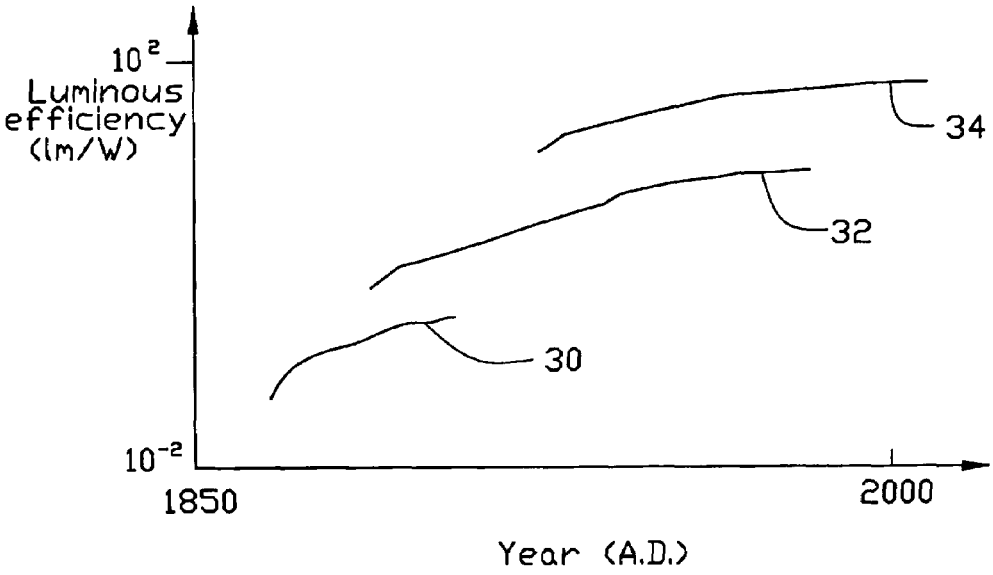
FIG. 5 (BACKGROUND ART)
FIG. 5 is a graph of luminous efficacies over a period covering the recent history of lighting technology.

Referring to FIG. 4, the silicon nitride base 18 may define a diameter d2 in the range of about 10 nanometers to about 100 nanometers. Preferably, each of the molybdenum tips 19 defines a bottom diameter d3 essentially equal to the diameter d2 of the silicon nitride base 18. Each of the molybdenum tips 18 defines an upper diameter d1 in the range of about 0.5 nanometers to about 10 nanometers, and defines an aspect ratio in the range from about 10 to about 4000, and preferably from about 20 to about 400. The silicon nitride base 18 and a corresponding single molybdenum tip 19 together define a height h in the range of about 100 nanometers to about 2000 nanometers.

In the first preferred embodiment and the second preferred embodiment, each of the molybdenum tips 19 may be closely combined with the silicon nitride base 18. Because the combined molybdenum tips 19 and the silicon nitride base 18 have good mechanical strength, excellent field-emission capability and good Young's modulus, the combined molybdenum tips 19 and the silicon nitride base 18 can be subjected to relatively high voltage electrical fields without being damaged.

A high voltage electrical field may ensure a high current of field emission. The high current of field emission gives the lighting device a high luminosity, with visible light having satisfactory brightness being obtained. Therefore the lighting device 10 and the lighting device 20 with the molybdenum tips 19 and the silicon nitride base 18 may emit light having relatively high brightness. The brightness is about 10 to about 1000 times that of a comparable light emitting diode (LED) or high intensity discharge (HID) lamp.

The lighting device of the first and the second preferred embodiments may be applied in various illumination products. For example, the lighting device may be employed in a headlight of an automobile.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A lighting device comprising:
a cathode;
a cover on the cathode;
an insulation layer on the cover;
an emitter base on the insulation layer;
a molybdenum tip adjoining the base;
a phosphor layer spaced apart from the molybdenum tip;
an anode on the phosphor layer; and
a silicon oxide layer on the anode.

2. The lighting device of claim 1, wherein the emitter base defines a diameter in the range of about 10 nanometers to about 100 nanometers.

3. The lighting device of claim 2, wherein the molybdenum tip defines a bottom diameter essentially equal to the diameter of the emitter base.

4. The lighting device of claim 1, wherein the molybdenum tip defines an upper diameter in the range of about 0.5 nanometers to about 10 nanometers.

5. The lighting device of claim 1, wherein the emitter base and the molybdenum tip together define a height in the range of about 100 nanometers to about 2000 nanometers.

6. A lighting device comprising:
a non-conductive substrate;
a cover on the substrate;
a cathode on the cover;
an insulation layer on the cathode;
an emitter base on the insulation layer;
a molybdenum tip adjoining the base;
a phosphor layer spaced apart from the molybdenum tip;
an anode on the phosphor layer; and
a silicon oxide layer on the anode.

7. The lighting device of claim 6, wherein the emitter base defines a diameter in the range of about 10 nanometers to about 100 nanometers.

8. The lighting device of claim 7, wherein the molybdenum tip defines a bottom diameter essentially equal to the diameter of the emitter base.

9. The lighting device of claim 6, wherein the molybdenum tip defines an upper diameter in the range of about 0.5 nanometers to about 10 nanometers.

10. The lighting device of claim 6, wherein the emitter base and the molybdenum tip together define a height in the range of about 100 nanometers to about 2000 nanometers.

11. A lighting device comprising:
an anode disposed in the lighting device and capable of lighting after bombarding of electrons; and
an emitter assembly having at least one insulation emitter base and at least one molybdenum tip formed on the at least one insulation emitter base, the emitter assembly being spaced from the anode in the lighting device for emitting the electrons to bombard the anode via the at least one molybdenum tip.

12. The lighting device of claim 11, wherein the emitter base defines a diameter in the range of about 10 nanometers to about 100 nanometers.

13. The lighting device of claim 12, wherein the at least one molybdenum tip defines a bottom diameter essentially equal to the diameter of the base.

14. The lighting device of claim 11, wherein the at least one molybdenum tip defines an upper diameter in the range of about 0.5 nanometers to about 10 nanometers.

15. The lighting device of claim 12, wherein the base and the molybdenum tip together define a height in the range of about 100 nanometers to about 2000 nanometers.

16. The lighting device of claim 11, further comprising a phosphor layer formed on the anode and spaced from the at least one molybdenum tip for the lighting of the anode.

17. The lighting device of claim 1, wherein the emitter base is integrally formed with the insulation layer, and the molybdenum tip being deposited on the emitter base.

18. The lighting device of claim 6, wherein the emitter base is integrally formed with the insulation layer, and the molybdenum tip being deposited on the emitter base.

19. The lighting device of claim 11, further comprising an insulation layer, the at least one emitter base being integrally formed with the insulation layer, and the at least one molybdenum tip being deposited on the at least one emitter base.

20. The lighting device of claim 19, wherein a material of the insulation layer and the at least one emitter base is silicon nitride.

* * * * *